US006281843B1

(12) United States Patent
Evtioushkine et al.

(10) Patent No.: US 6,281,843 B1
(45) Date of Patent: Aug. 28, 2001

(54) PLANAR BROADBAND DIPOLE ANTENNA FOR LINEARLY POLARIZED WAVES

(75) Inventors: Guennadi Evtioushkine, Suwon; Je-woo Kim, Sungnam; Kyung-sup Han, Suwon, all of (KR)

(73) Assignee: SamSung Electronics Co., Ltd., Suwon (KR)

( * ) Notice: Subject to any disclaimer, the term of this patent is extended or adjusted under 35 U.S.C. 154(b) by 0 days.

(21) Appl. No.: 09/332,144

(22) Filed: Jun. 14, 1999

(30) Foreign Application Priority Data

Jul. 31, 1998 (KR) ..... 98-31173

(51) Int. Cl.[7] ..... H01Q 1/38

(52) U.S. Cl. ..... 343/700 MS; 343/795; 343/815; 343/841

(58) Field of Search ..... 343/795, 815, 343/700 MS, 841; H01Q 1/38

(56) References Cited

U.S. PATENT DOCUMENTS

| | | | | |
|---|---|---|---|---|
| 3,887,925 | * | 6/1975 | Ranghelli et al. | 343/795 |
| 4,081,803 | * | 3/1978 | Dempsey | 343/795 |
| 4,318,109 | | 3/1982 | Weathers | 343/806 |
| 4,460,894 | * | 7/1984 | Robin et al. | 343/700 MS |
| 4,812,855 | * | 3/1989 | Coe et al. | 343/815 |
| 5,563,616 | | 10/1996 | Dempsey et al. | 343/753 |
| 5,748,152 | | 5/1998 | Glabe et al. | 343/767 |
| 5,847,682 | | 12/1998 | Ke | 343/752 |

FOREIGN PATENT DOCUMENTS

| | | |
|---|---|---|
| 0064313 | 10/1982 | (EP) . |
| WO 94/13029 | 9/1994 | (WO) . |
| WO 98/56067 | 12/1998 | (WO) . |

OTHER PUBLICATIONS

Bailey M..C. 'Broad–band half–wave dipole', IEEE Trans., 1984. AP–32, No. 4, Apr. 1984, pp. 410–412.

* cited by examiner

*Primary Examiner*—Michael C. Wimer
(74) *Attorney, Agent, or Firm*—Robert E. Bushnell, Esq.

(57) ABSTRACT

A planar broadband dipole antenna including a grounded conductor plate, a radiation plate placed over the grounded conductor plate, the radiation plate having printed patterns formed on both sides, and a dielectric interposed between the grounded conductor plate and the radiation plate. Each of the upper and lower surfaces of the radiation plate includes a dipole element for radiating waves, and a feeder for feeding radio frequency signals. Accordingly, the basic advantages of micro strip antennas are included, i.e., small volume, small weight, and natural integration with printed circuits. Also, the radiation losses of the twin feed lines in the planar dipole antenna are extremely low.

18 Claims, 7 Drawing Sheets

PLANAR BROADBAND DIPOLE ANTENNA FOR LINEARLY POLARIZED WAVES

CLAIM OF PRIORITY

This application makes reference to, incorporates the same herein, and claims all benefits accruing under 35 U.S.C §119 from an application entitled Planar Broadband Dipole Antenna For Linearly Polarized Waves earlier filed in the Korean Industrial Property Office on Jul. 31, 1998, and there duly assigned Ser. No. 98-31173 by that Office.

BACKGROUND OF THE INVENTION

1. Field of the Invention

The present invention relates to planar antennas, and more particularly, to a planar broadband dipole antenna capable of linearly receiving and transmitting waves over a wide band.

2. Description of the Related Art

Various planer antennas are depicted by: U.S. Pat. No. 4,318,109 to Paul Weathers entitled Planar Antenna With Tightly Wound Folded Sections which describes a broadband antenna system capable of receiving VHF, FM, and UHF bands, providing sharp nulls for the rejection of unwanted reflections, and having broad directional properties and no radiation capabilities. Cited as a background reference of a planar broad-band antenna; U.S. Pat. No. 5,563,616 to Richard C. Dempsey, et al. entitled Antenna Design Using A High Index, Low Loss Material which describes an antenna having a dipole element which includes two bow-tie shaped arms positioned on a high index of refraction substrate, the opposite surface of which is covered by ground plane. Signal power is applied to (or received from) the arms by balanced feed lines. The construction of dipole element is similar to that of a conventional dipole element in that it is formed by depositing, plating or etching the metal arms on the substrate; U.S. Pat. No. 5,748,152 to John R. Glabe, et al. entitled Broad Band Parallel Plate Antenna which describes a broad-band antenna formed from a relatively thin metal layer (e.g., copper) deposited on a major surface of an electrically insulative substrate. The metal layer has been etched away to leave first and second slot sections of identical symmetrical shape, the two symmetrical slot sections serve as the two antenna elements that form the slot antenna. A top metal plate, sheet or layer of copper or other conductive material is disposed above the antenna so as to be closely spaced and parallel or nearly parallel to the antenna. The metal plate having the back edge and a forward edge which is relatively transverse to an axis defined by the transition portion. To prevent radiation leakage out the back, the back edge of the metal plate is shorted or grounded to the antenna by means of a back or rear metal plate of copper or other conductive material which is nearly perpendicular or orthogonal to the metal plate and the antenna. The bottom edge of the rear metal plate is disposed in back of the linking slot. Also, the rear metal plate is relatively transverse to the axis defined by the symmetrical slot sections. Insomuch as the direction of the electromagnetic radiation in this embodiment is desired to be from the transition portion towards the antenna aperture, the shorted back plate acts to stop and absorb radiation in the opposite direction thereto; and U.S. Pat. No. 5,847,682 to Shyh-Yeong Ke entitled Top Loaded Tiangular Printed Antenna which describes a top loaded triangular printed antenna which will provide a planar antenna structure with broad bandwidth and high radiation efficiency. The antenna s structure has a vertical rectangular load, a triangular-shaped resonator having a smooth tapered section, a pair of grounded strips, a microstrip input transmission line, a grounding surface and a dielectric medium. Preferably, the grounded strips, the grounding surface and the rectangular load are metallic strip conductors printed on different planes of a dielectric medium of a printed circuit board.

An antenna can be generally considered as a special type of electrical circuit which is used in connection with a high frequency circuit. A transmission antenna efficiently transforms the power of a high frequency circuit into electromagnetic wave energy and radiates the electromagnetic wave energy in a space. A receiving antenna efficiently transforms the energy of input electromagnetic waves into power and transmits the power to an electrical circuit. As described above, the antenna serves as an energy transformer between the electrical circuit energy and electromagnetic wave energy, and its size and shape are appropriately designed to improve the efficiency of the transformation.

The bandwidth limitation of printed antennas is an inherent property, which comes from the resonant conditions at a single radiator. Thus, the bandwidth of a conventional patch radiator on a thin substrate is limited to 2% from its center frequency. The utilization of thick and multi-layer dielectrics provides a chance to increase the bandwidth by about 15% from its center frequency.

The use of a thick dielectric substrate can cause several problems. First, the excitation of surface waves is increased. Second, in the case of a printed feed network, the radiation losses are high. Third, the weight and cost of the device is increased. Fourth, there is a serious problem of reflection and radiation of a vertical feed. A very wide dipole was even shown to have a bandwidth of 37% from its center frequency (BAILEY. M. C. 'Broadband half-wave dipole', IEEE Trans., 1984. AP-32, pp. 410–412).

However, this antenna has the following disadvantages: a long distance between a grounded conductor plate and a radiator (about 0.39$\lambda$, where $\lambda$ is the wavelength); and a decrease in bore side radiation level (about 3 dB). These problems act as significant obstacles when the above antenna is used as a radiator consisting of an antenna array.

SUMMARY OF THE INVENTION

To solve the above problems, it is an objective of the present invention to provide a planar broadband dipole antenna both as a single radiator and as a component of an antenna array, capable of receiving and transmitting linearly polarized waves over a wide band.

Accordingly, to achieve the above objective, there is provided a planar broadband dipole antenna comprising: a grounded conductor plate; a radiation plate placed over the grounded conductor plate, the radiation plate having printed patterns formed on both sides; and a dielectric interposed between the grounded conductor plate and the radiation plate. Each of the upper and lower surfaces of the radiation plate comprises a dipole element for radiating waves, and a feeder or feeding radio frequency signals.

The upper and lower surfaces of the radiation plate each further comprise parasitic elements arranged on both sides of the dipole element for blocking dispersion of waves radiated from the dipole element.

The lower surface of the radiation plate further comprises a strip line frame element which circumscribes the radiation plate on the inside of the radiation plate edge, and prevents radio interference with other dipole antennas when the dipole antenna is connected in an array.

The feeder formed on the upper and lower surfaces of the radiation plate comprises: a line-balance converter (BALUN) for receiving radio frequency signals and achieving impedance balance; a matching element connected to the line-balance converter for achieving impedance matching; and a feed line for feeding the radio frequency signals, passed through the line-balance converter and the matching element, to the dipole element.

BRIEF DESCRIPTION OF THE DRAWINGS

A more complete appreciation of the present invention, and many of the attendant advantages thereof, will become readily apparent as the same becomes better understood by reference to the following detailed description when considered in conjunction with the accompanying drawings in which like reference symbols indicate the same or similar components, wherein.

DESCRIPTION OF THE PREFERRED EMBODIMENT

A conception of the present invention is realized by forming the elements of an antenna with a printed dipole printed on both sides of a thin substrate. A feed unit is made of twin lines respectively on the top and bottom surfaces of the thin printed substrate, and a dielectric having a dielectric constant of almost 1 is interposed between the printed elements and a grounded conductor plate.

This structure has the basic advantages of micro strip antennas, i.e., small volume, small eight, natural integration with printed circuits, and small losses. The radiation losses in the twin feed lines are extremely low, since the thickness of the thin printed substrate can be less than 0.01λ.

Figure 1:
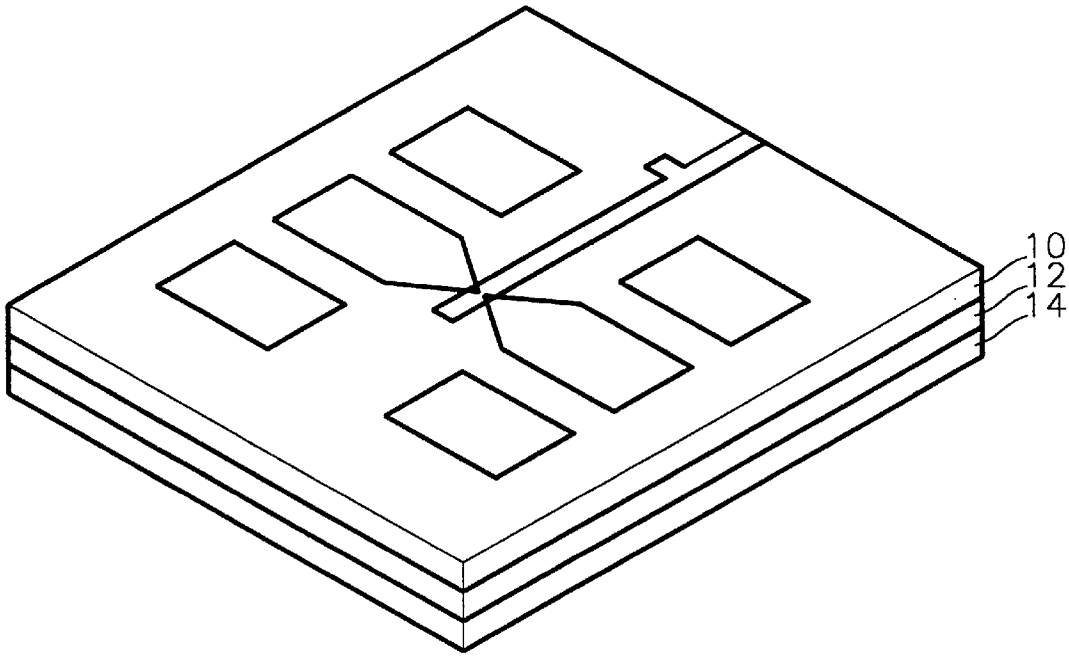
FIG. 1 is a perspective view of a planar antenna for linearly polarized waves according to an embodiment of the present invention.

FIG. 1 is a perspective view of a planar antenna for linearly polarized waves according to an embodiment of the present invention. The planar dipole antenna shown in FIG. 1 comprises a radiation plate 10, a grounded conductor plate 14, and a dielectric 12 inserted between the radiation plate 10 and the grounded conductor plate 14. The grounded conductor plate 14 is connected to ground, and formed of an aluminum plate of about 1–2 mm thickness. The radiation plate 10 is placed over the grounded conductor plate 14, and has printed patterns formed on both sides.

Figure 2:
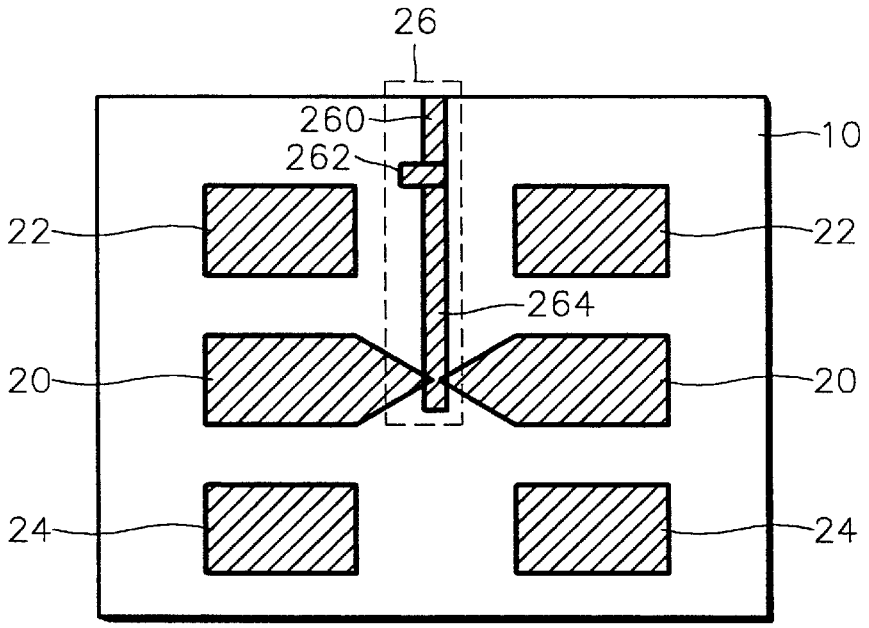
FIG. 2 is a top view of a radiation plate on which a printed pattern is formed.

FIG. 2 is a top view of the radiation plate on which printed patterns are formed. The radiation plate fundamentally includes a dipole element 20 for radiating waves, and a feeder 26 for feeding radio frequency signals. Preferably, the radiation plate further comprises parasitic elements 22 and 24 arranged on either side of the dipole element 20 for preventing dispersion of waves radiated from the dipole element 20. The feeder 26 is comprised of a line-balance converter 260, a matching element 262, and a feed line 264. The line-balance converter 260 receives the radio frequency signals and achieves impedance balancing. The matching element 262 is connected to the line-balance converter 260 and achieves impedance matching. The feed line 264 feeds the radio frequency signals passed through the line-balance converter 260 and the matching element 262 to the dipole element 20. The feeder 26 and the dipole element 20 are formed of conductive strips, and are preferably made of copper, aluminum, iron or another metal. Also, the feeder 26 and the dipole element 20 are formed by etching a plastic sheet made of fiber glass, polyethylene, Teflon, or a mixture of two or more of these.

Figure 3:
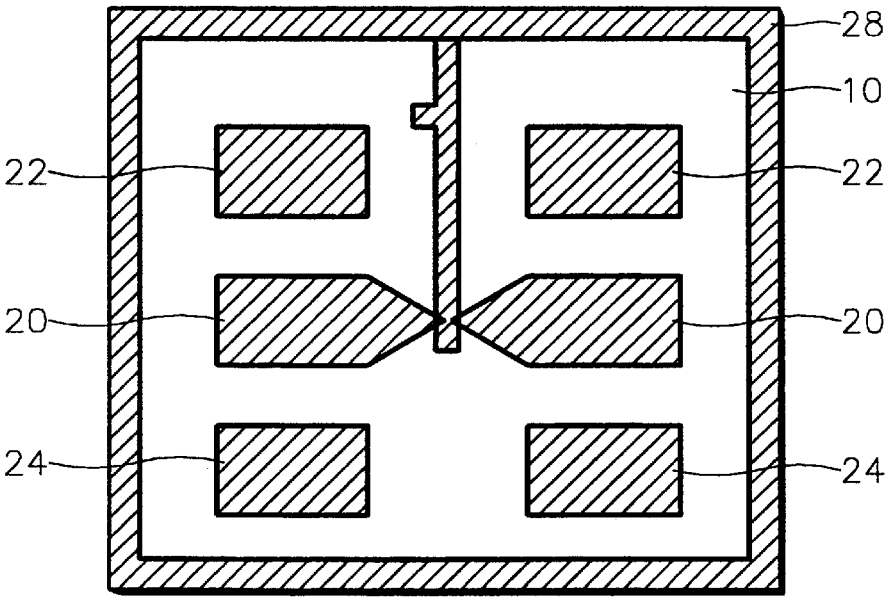
FIG. 3 is a bottom view of a radiation plate on which a printed pattern is formed.

FIG. 3 is a bottom view of the radiation plate 10 on which printed patterns are formed. Here, the bottom surface of the radiation plate 10 has the same pattern as the top surface thereof. Also, it is preferable that the bottom surface further comprises a strip line frame element 28 circumscribing the radiation plate 10 on the inside of the radiation plate 10 edge. The frame element 28 prevents radio interference with other dipole antennas when the dipole antenna is formed as a stacked array.

Figure 4:
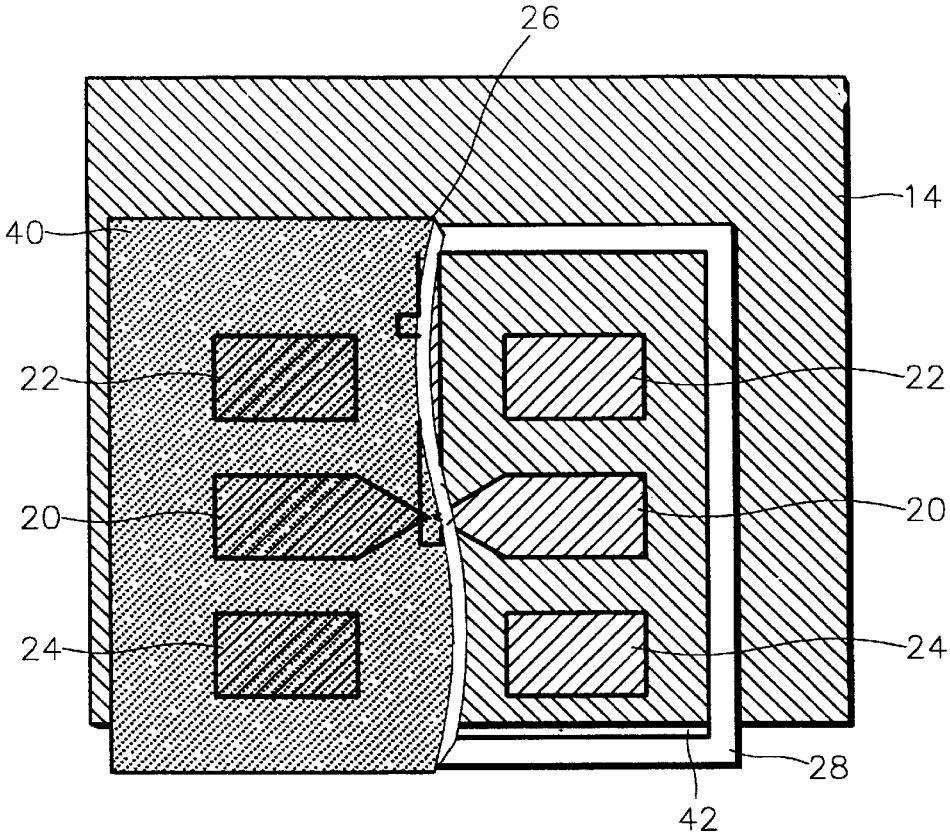
FIG. 4 is a perspective view of a planar antenna for linearly polarized waves according to an embodiment of the present invention.

FIG. 4 is a perspective view of a planar antenna for linearly polarized waves according to an embodiment of the present invention. Here, reference numeral 40 denotes the top surface of the radiation plate 10, and reference numeral 42 denotes the bottom surface of the radiation plate 10.

Figure 5:
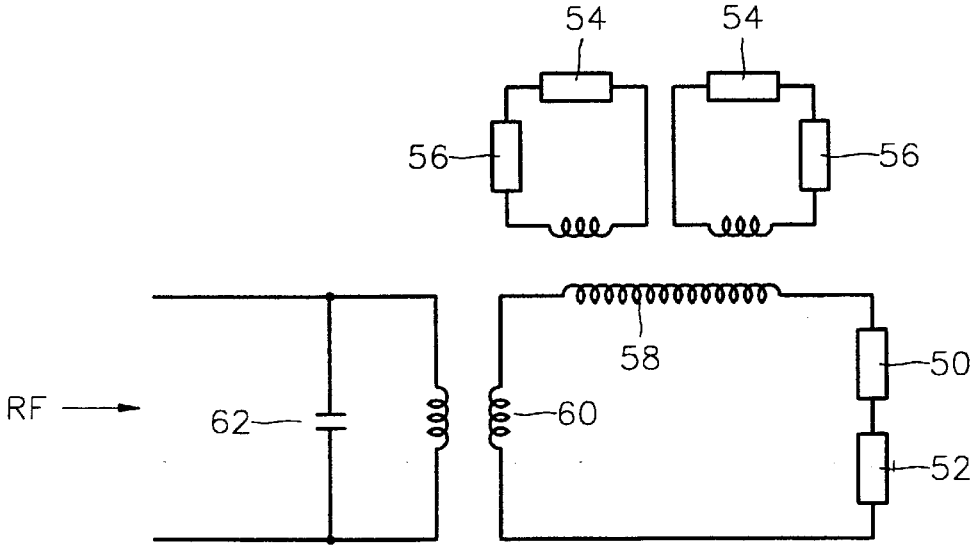
FIG. 5 is an equivalent circuit of a planar dipole antenna according to the present invention.

FIG. 5 is an equivalent circuit of the planar dipole antenna of FIG. 1. The dipole element 20 has its own resistance 50 and reactance 52. The frequency band of the planar antenna is limited by the reactance 52. The parasitic elements 22 and 24 have their own resistance 54 and reactance 56.

A transformer 58 denotes the equivalent circuit for the passive coupling relationship between the dipole element 20 and the parasitic elements 22 and 24. The resistance 54 and the reactance 56 are changed by the transformer 58. Reference numeral 60 denotes a transformer of the feeding line 264 which is utilized for achieving impedance matching of the feeding line. Reference numeral 62 denotes the equivalent circuit of the matching element 262 which is utilized for achieving impedance matching of the dipole element 20.

Figure 6:
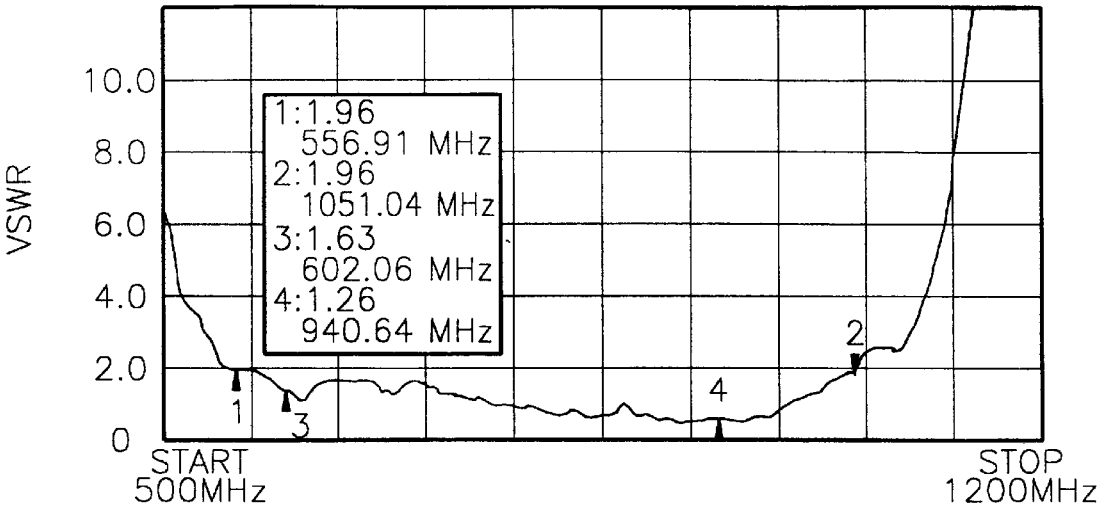
FIG. 6 is a diagram showing the voltage standing wave ratio (VSWR) for the antenna according to the present invention.

FIG. 6 is a diagram showing the voltage standing wave ratio (VSWR) for the antenna in relation to the changes in frequency according to the present invention. In general, the bandwidth range of an antenna is typically defined as VSWR≦2. The frequency band satisfying the condition of VSWR≦2 in FIG. 6 is about 70% in the frequency band of 500–1200 MHz.

Figure 7:
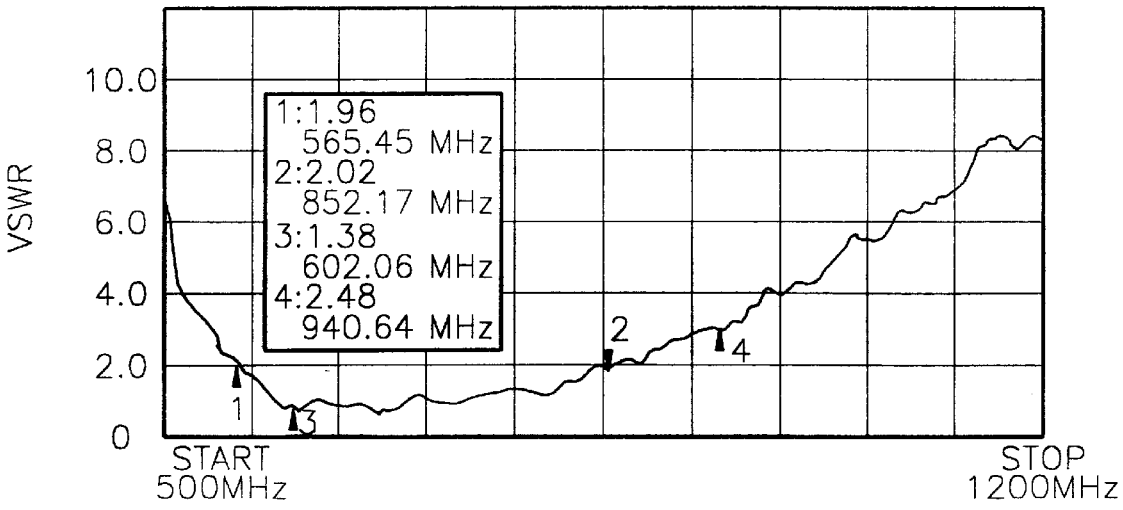
FIG. 7 is a diagram showing the VSWR for the antenna according to the present invention without a strip line frame element and parasitic elements.

FIG. 7 is a diagram showing the VSWR for the antenna according to the present invention without the strip line frame element 28 and the parasitic elements 22 and 24. The frequency band in this case (satisfying the condition of VSWR≦2) is about 40% in the frequency band of 500–1200 MHz.

Figure 8:
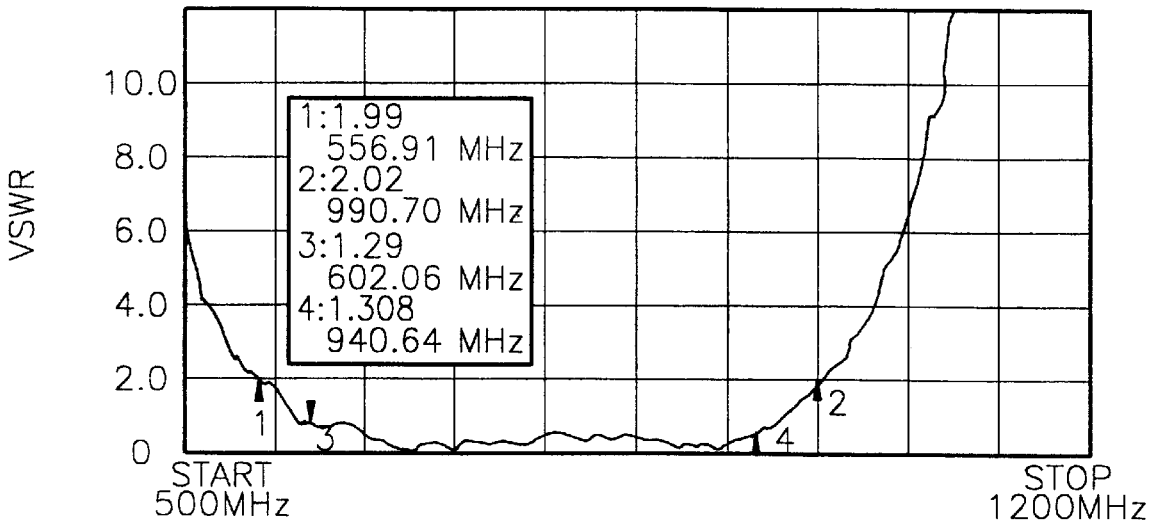
FIG. 8 is a diagram showing the VSWR for the antenna according to the present invention without strip line frames.

FIG. 8 is a diagram showing the VSWR for the antenna according to the present invention without the strip line frame element 28. The frequency band satisfying the condition of VSWR≦2 is about 60% in the frequency band of 500–1200 MHz. This case is good for single transmission antennas with big power level.

Figure 9:
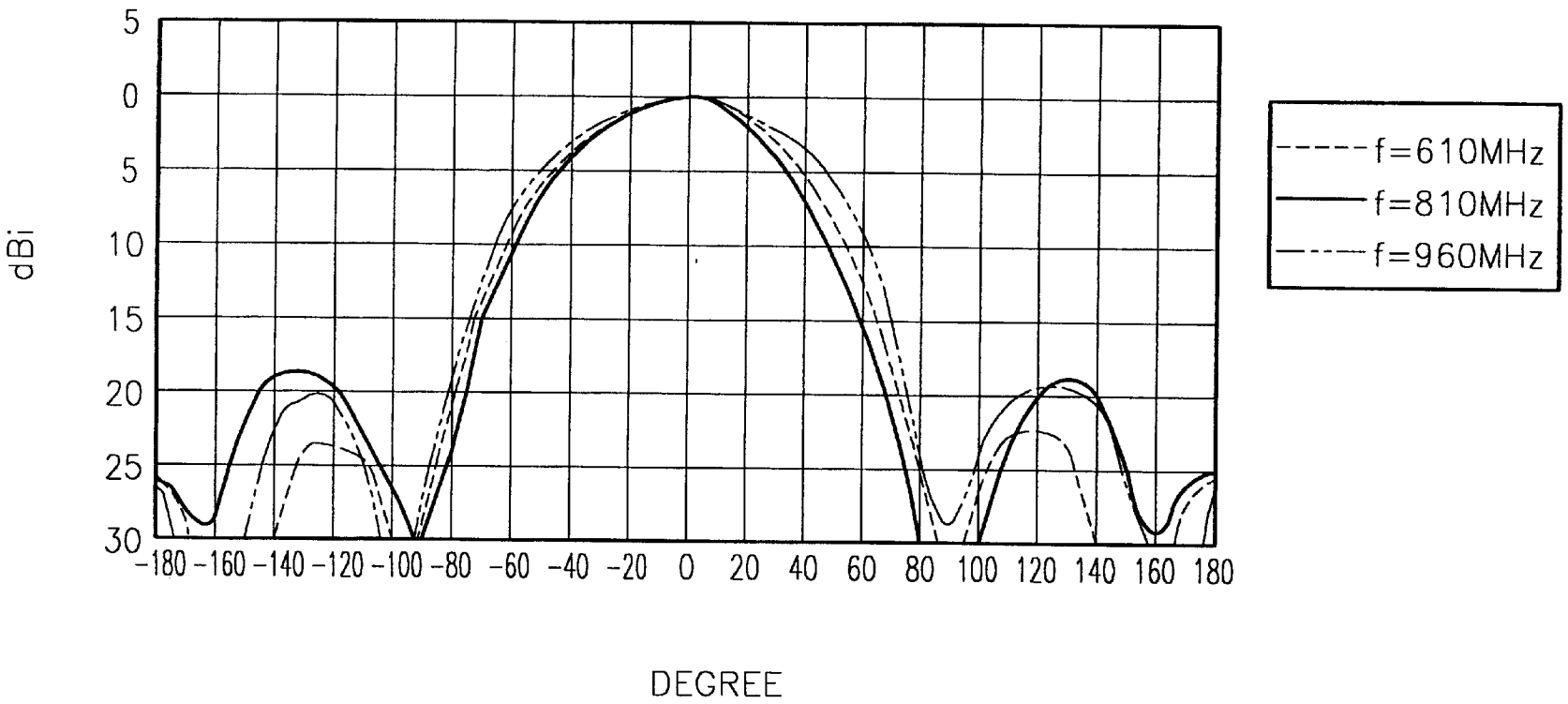
FIG. 9 is a diagram showing a radiation pattern for E-plane.
Figure 10:
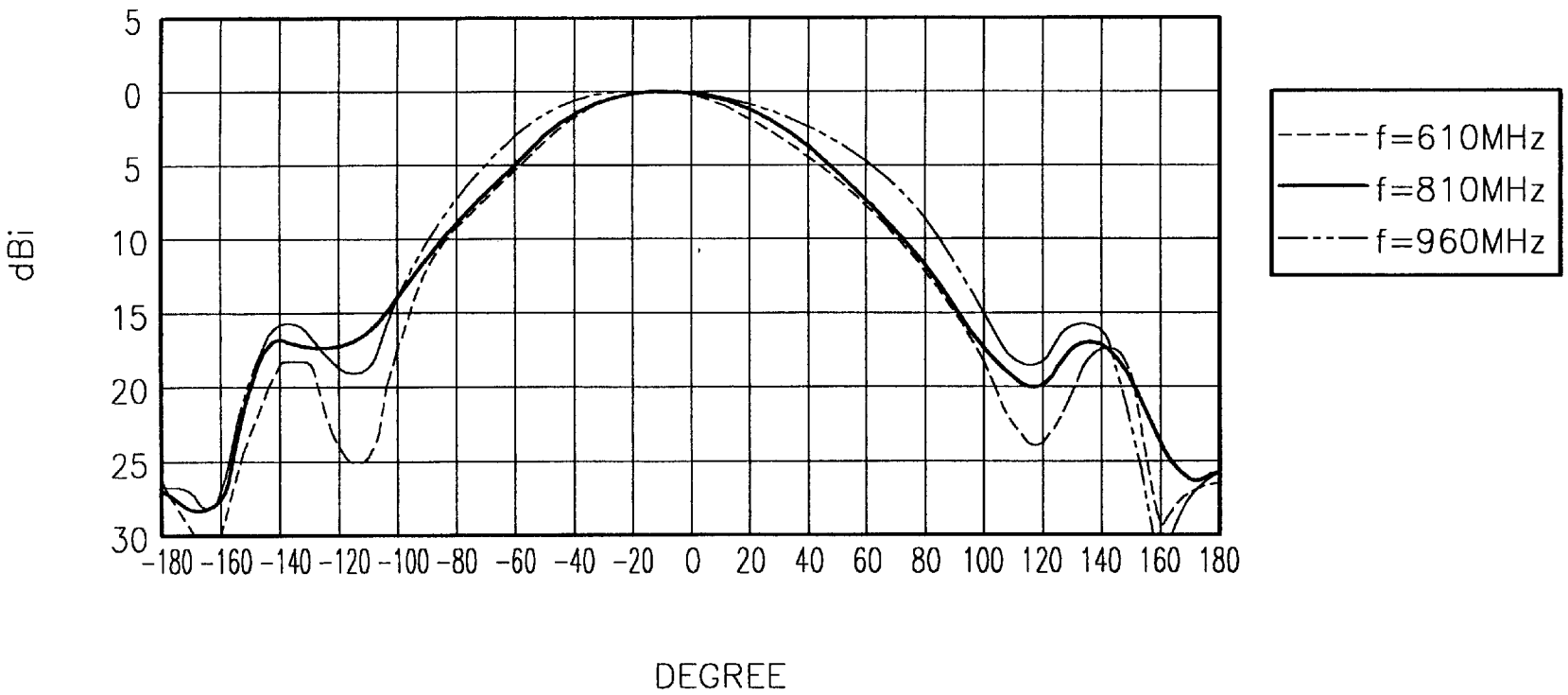
FIG. 10 is a diagram showing a radiation pattern for H-plane.

FIG. 9 is a diagram showing a radiation pattern for the E-plane. FIG. 10 is a diagram showing a radiation pattern for the H-plane.

The present invention includes the basic advantages of micro strip antennas, i.e., low volume, small weight, natural integration with printed circuits, and small losses.

The radiation losses of the twin feed lines in the planar dipole antenna of the present invention are extremely low.

Furthermore, the planar dipole antenna of the present invention can be utilized as a component of an antenna array for wireless communications systems.

What is claimed is:

1. A planar broadband dipole antenna, comprising:

a grounded conductor plate;

a radiation plate placed over the grounded conductor plate which does not contact with the grounded conductor plate, the radiation plate having printed patterns formed on the upper and lower surfaces of the radiation plate, said upper and lower surfaces of the radiation plate each further comprising a pair of parasitic elements, said patterns each comprising;

a dipole element for radiating waves, said dipole element being disposed between said pair of parasitic elements, said pair of parasitic elements blocking dispersion of the waves radiated from the dipole element; and a feeder for feeding radio frequency signals to said dipole element; and a dielectric interposed between the grounded conductor plate and the radiation plate.

2. The planar broadband dipole antenna as claimed in claim 1, wherein the lower surface of the radiation plate further comprises a strip line frame element which circumscribes the radiation plate on the inside of the radiation plate edge for preventing radio interference with other dipole antennas when the dipole antenna is connected in an array.

3. The planar broadband dipole antenna as claimed in claim 1, wherein the feeder formed on the upper and lower surfaces of the radiation plate comprises:

a line-balance converter for receiving said radio frequency signals and achieving impedance balance;

a matching element connected to the line-balance converter for achieving impedance matching; and a feed line for feeding the radio frequency signals, passed through the line-balance converter and the matching element, to the dipole element.

4. The planar broadband dipole antenna as claimed in claim 1, wherein the dielectric has a dielectric constant of nearly 1.

5. The planar broadband dipole antenna as claimed in claim 1, wherein the conductor plate is made of aluminum and has a thickness of 1–2 mm.

6. The planar broadband dipole antenna as claimed in claim 3, wherein the feed line is made of copper.

7. The planar broadband dipole antenna as claimed in claim 3, wherein the feed line is formed of conductive strips made of copper.

8. The planar broadband dipole antenna as claimed in claim 3, wherein the feed line is formed of conductive strips made of aluminum.

9. The planar broadband dipole antenna as claimed in claim 3, wherein the feed line is formed of conductive strips made of iron.

10. The planar broadband dipole antenna as claimed in claim 1, wherein the feeder and the dipole element are formed by etching a plastic sheet made of fiber glass, polyethylene, Teflon, or a mixture of two or more of these.

11. A planar broadband dipole antenna, comprising:

a grounded conductor plate;

a radiation plate placed over and spaced-apart from said grounded conductor plate, said radiation plate having printed patterns formed on the upper and lower surfaces of said radiation plate, said upper and lower surfaces of the radiation plate each further comprising a pair of parasitic elements, said patterns each comprising:

a dipole element for radiating waves, said dipole element being disposed between said pair of parasite elements, said pair of parasitic elements blocking dispersion of the waves radiated from the dipole element; and a feeder for feeding radio frequency signals to said dipole element; and a dielectric interposed between the grounded conductor plate and the radiation plate.

12. The planar broadband dipole antenna as claimed in claim 11, wherein the lower surface of the radiation plate further comprises a strip line frame element which circumscribes the radiation plate on the inside of the radiation plate edge for preventing radio interference with other dipole antennas when the dipole antenna is connected in an array.

13. The planar broadband dipole antenna as claimed in claim 11, wherein the feeder formed on the upper and lower surfaces of the radiation plate comprises:

a line-balance converter for receiving said radio frequency signals and achieving impedance balance;

a matching element connected to the line-balance converter for achieving impedance matching; and a feed line for feeding the radio frequency signals, passed through the line-balance converter and the matching element, to the dipole element.

14. The planar broadband dipole antenna as claimed in claim 11, wherein the dielectric as a dielectric constant of nearly one.

15. The planar broadband dipole antenna as claimed in claim 11, wherein the conductor plate is made of aluminum and has a thickness of about 1–2 millimeters.

16. The planar broadband dipole antenna as claimed in claim 13, wherein the feed line is made of copper.

17. The planar broadband dipole antenna as claimed in claim 13, wherein the feed line is formed of conductive strips made of aluminum.

18. The planar broadband dipole antenna as claimed in claim 13, wherein the feed line is formed of conductive strips made of iron.

* * * * *